US009738085B2

(12) United States Patent
Danzuka et al.

(10) Patent No.: US 9,738,085 B2
(45) Date of Patent: Aug. 22, 2017

(54) INKJET RECORDING APPARATUS

(71) Applicant: CANON KABUSHIKI KAISHA, Tokyo (JP)

(72) Inventors: Toshimitsu Danzuka, Tokyo (JP); Masaya Uetsuki, Yokohama (JP); Kazuo Suzuki, Yokohama (JP); Masataka Kato, Yokohama (JP); Tsuyoshi Ibe, Yokohama (JP); Asako Tomida, Kawasaki (JP); Shin Genta, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/084,304

(22) Filed: Mar. 29, 2016

(65) Prior Publication Data

US 2016/0288519 A1 Oct. 6, 2016

(30) Foreign Application Priority Data

Apr. 2, 2015 (JP) ..... 2015-076282

(51) Int. Cl.
*B41J 2/175* (2006.01)
*B41J 29/38* (2006.01)
*B41J 2/165* (2006.01)

(52) U.S. Cl.
CPC ..... *B41J 2/17566* (2013.01); *B41J 2/16508* (2013.01); *B41J 2/16523* (2013.01); *B41J 2/175* (2013.01); *B41J 2/17506* (2013.01); *B41J 2/17513* (2013.01); *B41J 29/38* (2013.01); *B41J 2002/17579* (2013.01)

(58) Field of Classification Search
CPC ..... B41J 2/17566; B41J 2/17506; B41J 2002/17579; B41J 2/16508; B41J 2/16523; B41J 29/38; B41J 2/175; B41J 2/17513
See application file for complete search history.

(56) References Cited

U.S. PATENT DOCUMENTS 6,286,921 B1 * 9/2001 Ochi ..... B41J 2/17513 347/7

FOREIGN PATENT DOCUMENTS

JP 2013-184424 * 9/2013 ..... B41J 2/175
JP 2013-184424 A 9/2013

* cited by examiner

*Primary Examiner* — Manish S Shah
*Assistant Examiner* — Yaovi M Ameh
(74) *Attorney, Agent, or Firm* — Canon USA, Inc. IP Division

(57) ABSTRACT

An inkjet recording apparatus includes a first ink tank that contains ink, a second ink tank that contains ink supplied from the first ink tank, a communication unit, having conductivity, communicates between the first ink tank and the second ink tank, an opening provided at one end of the communication unit connected to the second ink tank and opening to the second ink tank, an electrode portion provided in the second ink tank, of which a lower end position is located at or above a lower end position of the one end of the communication unit and at or below a highest position of the opening, and a detecting unit that detects an ink amount in the second ink tank in accordance with electrical properties between the electrode portion and the communication unit.

12 Claims, 9 Drawing Sheets

INKJET RECORDING APPARATUS

BACKGROUND

Field

Aspects of the present invention generally relate to an inkjet recording apparatus provided with a sub tank disposed between a recording head and an ink tank.

Description of the Related Art

Inkjet recording apparatuses provided with a sub tank have been used widely. Japanese Patent Laid-Open No. 2013-184424, for example, discloses an inkjet recording apparatus provided with a sub tank.

As illustrated in FIG. 9, the inkjet recording apparatus disclosed in Japanese Patent Laid-Open No. 2013-184424 is provided with a sub tank 400 disposed below an ink tank 500 in the vertical direction. The sub tank 400 and a recording head 100 communicate with each other via a supply tube 200. The ink tank 500 and the sub tank 400 communicate with each other via a hollow pipe 800 formed by a metal needle.

The inkjet recording apparatus disclosed in Japanese Patent Laid-Open No. 2013-184424 is further provided with an ink reservoir 300 of which volume is variable. The ink reservoir 300 is formed by a flexible member and is located between the sub tank 400 and the supply tube 200. As the ink reservoir 300 increases in volume, ink in the ink tank 500 is drawn into the sub tank 400, and as the ink reservoir 300 decreases in volume, air in the sub tank 400 is pushed out to the ink tank 500.

In the inkjet recording apparatus disclosed in Japanese Patent Laid-Open No. 2013-184424, a metal solid pipe 808 is provided on a top panel of the sub tank 400. Whether the sub tank 400 is filled with ink is determined by a resistance value when a weak current is made to flow between the solid pipe 808 and the hollow pipe 800. A lower end 809 of the solid pipe 808 is disposed lower than a lower end 807 of the hollow pipe 800.

That is, when both the lower end 807 of the hollow pipe 800 (an electrode) and the lower end 809 of the solid pipe 808 (an electrode) are in contact with a liquid surface in the sub tank 400 (i.e., when the sub tank 400 is in a full state), the resistance value between the electrodes (800 and 808) decreases. When the lower end (807 or 809) of the electrode (800 and 808) is not in contact with the liquid surface (i.e., when the sub tank 400 is not a full state), the resistance value between the electrodes (800 and 808) increases. Therefore, whether the sub tank 400 is filled with ink may be estimated (determined) based also on variation of the resistance value between the hollow pipe 800 (the electrode) and the solid pipe 808 (the electrode).

In the inkjet recording apparatus disclosed in Japanese Patent Laid-Open No. 2013-184424, as illustrated in FIG. 9, when the ink is supplied to the sub tank 400 from the ink tank 500 through the hollow pipe 800, the ink may drip at the lower end 807 of the hollow pipe 800 (a "liquid column" phenomenon). When an ink dripping portion (D) is brought into contact with the liquid surface, electrical resistance between the hollow pipe 800 (the electrode) and the solid pipe 808 (the electrode) decreases. Therefore, the electrical resistance between the electrodes (800 and 808) changes (decreases) while the liquid surface in the sub tank 400 has not actually risen up to the position of the lower end 807 of the hollow pipe 800. As a result, it may be wrongly detected that the sub tank 400 has been filled with ink (a full state).

Especially during the drawing of the ink in the sub tank 400 from the ink tank 500 by the ink reservoir 300, the ink dripping portion (D) is easy to appear and such wrong detection is easy to be conducted. Therefore, in the inkjet recording apparatus disclosed in Japanese Patent Laid-Open No. 2013-184424, the ink amount stored in the sub tank 400 cannot always be detected correctly.

SUMMARY OF THE INVENTION

Aspects of the present invention generally provide an inkjet recording apparatus that correctly detects an ink amount in a sub tank.

According to an aspect of the present invention provides an inkjet recording apparatus including a first ink tank configured to contain ink, a second ink tank configured to contain ink supplied from the first ink tank, a communication unit, having conductivity, configured to communicate between the first ink tank and the second ink tank, an opening provided at one end of the communication unit connected to the second ink tank, and opening to the second ink tank, an electrode portion provided in the second ink tank, of which a lower end position is located at or above a lower end position of the one end of the communication unit and at or below a highest position of the opening, and a detecting unit configured to detect an ink amount in the second ink tank in accordance with electrical properties between the electrode portion and the communication unit.

Further features of aspects of the present invention will become apparent from the following description of exemplary embodiments with reference to the attached drawings.

DESCRIPTION OF THE EMBODIMENTS

First Embodiment

Hereinafter, a first embodiment is described with reference to FIGS. 1 to 5. In the present embodiment, a serial inkjet recording apparatus is used as an inkjet recording apparatus.

1. Main Part Configuration of Inkjet Recording Apparatus

Figure 1:
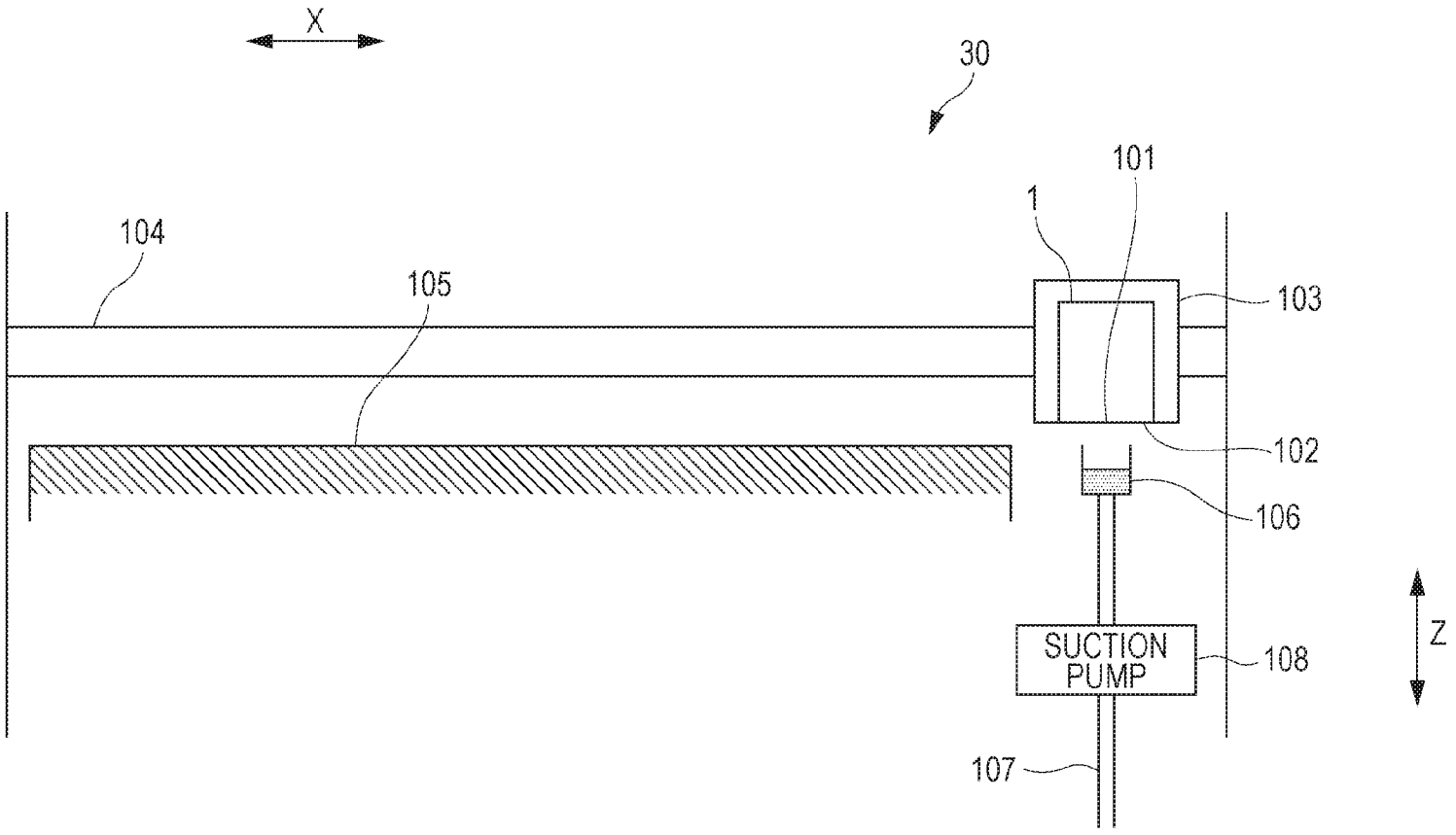
FIG. 1 is a conceptual cross-sectional view of an inkjet recording apparatus according to a first embodiment.

FIG. 1 is a conceptual cross-sectional view of an inkjet recording apparatus according to the first embodiment.

As illustrated in FIG. 1, an inkjet recording apparatus 30 (hereafter, "recording apparatus") of the present embodiment is provided with a recording head 1. The recording head 1 has an ejection port surface 102 on which an ejection port array 101 constituted by a plurality of ejection ports is provided. The recording head 1 ejects ink from the ejection ports at a recording medium and conducts a recording operation.

The recording head 1 is detachably attached to a carriage 103. The carriage 103 is guided by a guide shaft 104 provided in an apparatus main body and is reciprocatable in a main scanning direction (an X direction) when driven by an unillustrated carriage motor.

The recording head 1 attached to the carriage 103 conducts the recording operation on the recording medium in the X direction. The recording medium is conveyed intermittently by an unillustrated transportation unit in a conveyance direction (a Y direction) when the recording operation is not conducted. That is, the entire image to be recorded is formed on the recording medium by alternately repeating the recording operation in the X direction and the conveying operation in the Y direction.

In the present embodiment, 1,280 ink ejection ports are arranged in the ink ejection port array 101 at an interval of 1,200 dpi (dot per inch) in the direction vertical to the paper sheet of FIG. 1. An electrothermal transducer is provided inside of each ink ejection port. Upon application of an electrical signal based on a driving signal to the electrothermal transducer, air bubbles are generated in the ink and the ink is ejected from the ink ejection port with the pressure of the air bubbles.

The recording apparatus 30 has a cap 106 which covers the ejection port surface 102 of the recording head 1 to reduce evaporation of a solvent in the ink from the ink ejection port. The cap 106 is reciprocatable in a Z direction (a gravity direction) illustrated in FIG. 1 between a capping position at which it is in close contact with the ejection port surface 102 and an away position (a position illustrated in FIG. 1) at which it is away from the ejection port surface 102. The cap 106 is connected to a suction pump 108 via a pump tube 107, and can suck and discharge the ink from the recording head 1 by a suctioning operation of the suction pump 108.

In the present embodiment, the cap 106 has an ink absorber for absorbing ink. The ink which is sucked and discharged by the suctioning operation of the suction pump 108 from the cap 106 is contained in an unillustrated maintenance cartridge.

2. Channel Configuration of Inkjet Recording Apparatus

Figure 2A:
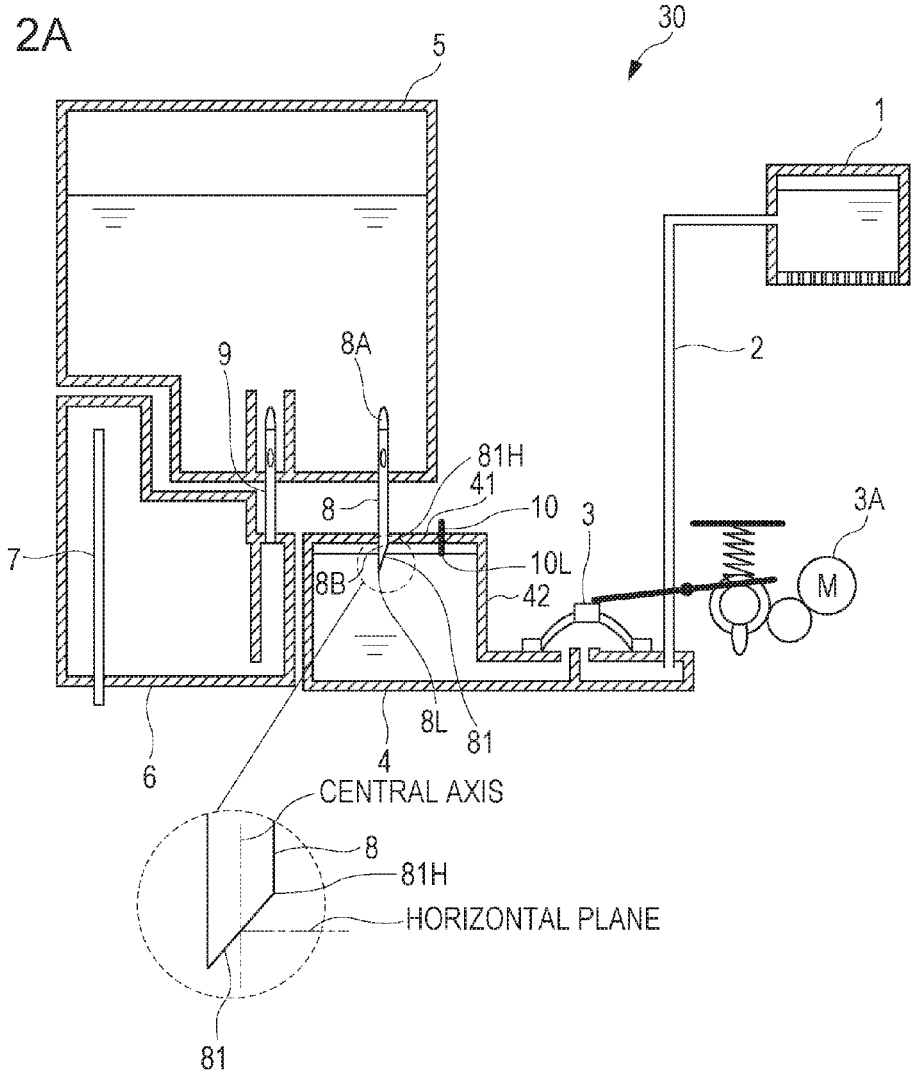
FIG. 2A is a conceptual diagram of an ink channel of the inkjet recording apparatus according to the first embodiment.
Figure 2B:
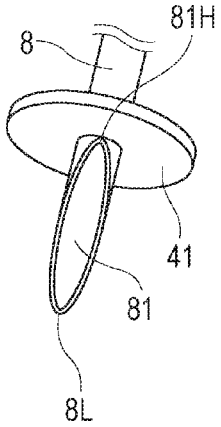
FIG. 2B is a conceptual perceptive view of a main part thereof.

FIG. 2A is a conceptual diagram of an ink channel of the inkjet recording apparatus according to the first embodiment. Although an ink channel for a single color is described in the present embodiment, aspects of the present invention are applicable to ink channels for plural colors.

As illustrated in FIG. 2A, a recording apparatus 30 of the present embodiment has an ink tank 5 (a first ink tank) which mainly contains ink, and a sub tank 4 (a second ink tank) which is disposed below the ink tank 5 and contains ink supplied from the ink tank 5. A metal first hollow pipe 8 (a communication unit) which communicates the ink tank 5 and the sub tank 4 and has conductivity is provided between the ink tank 5 and the sub tank 4. The recording apparatus 30 of the present embodiment has the recording head 1 for recording with the ink supplied from the sub tank 4, the ink reservoir 3 disposed on a channel between the sub tank 4 and the recording head 1, an air communication portion 6 communicating with the ink tank 5, and the like.

Ink Tank

The ink tank 5 is a container with an internal space for containing the ink, and is detachably attached to the apparatus main body. A first and a second joint portions (not illustrated) for connecting with the sub tank 4 or the air communication portion when the ink tank 5 is attached to the apparatus main body are provided at a bottom portion of the ink tank 5. The first and the second joint portions are formed by, for example, elastic rubber plugs.

Sub Tank

The sub tank 4 is disposed on a channel connecting the ink tank 5 and the recording head 1, and temporarily stores the ink supplied to the recording head 1 from the ink tank 5. A later-described first hollow pipe 8 is provided at an upper surface of the sub tank 4.

Communication Unit

Hereinafter, the first hollow pipe 8 (the communication unit) as a feature of aspects of the present invention is described.

In the present embodiment, the first hollow pipe 8 (the communication unit) is a cylindrical member provided in the vertical direction in an upper surface 41 of the sub tank 4 as illustrated in FIG. 2A. The first hollow pipe 8 is disposed to perpendicularly cross the upper surface 41.

The first hollow pipe 8 has an end 8A (an upper end) connected to the ink tank 5, and an end 8B (one end) (a lower end) connected to the sub tank 4. The first hollow pipe 8 is disposed with the end 8B (the lower end) projecting into an internal space of the sub tank from the upper surface 41 of the sub tank, and has an opening 81 (see also FIG. 8A) opening in the sub tank 4.

When the ink tank 5 is attached to the apparatus main body (the sub tank 4), the end 8A (the upper end) is inserted in the internal space from the bottom surface of the ink tank 5 through the first joint portion provided in the bottom portion of the ink tank 5. With the ink tank 5 being attached to the sub tank 4, air in the sub tank 4 is moved to the ink tank 5 by a later-described ink reservoir 3 (a filling unit) through the first hollow pipe 8, and the ink in the ink tank is moved to the sub tank 4. Therefore, the ink is supplied from the ink tank 5 through the first hollow pipe 8 to the sub tank 4, and the liquid surface in the sub tank 4 rises.

In the present embodiment, the opening 81 is formed by obliquely cutting the end 8B (the lower end) of the first hollow pipe 8. That is, an opening surface on which the opening 81 exists does not cross the axis direction of the first hollow pipe 8 perpendicularly, but is inclined with respect to the axis direction. Since the first hollow pipe 8 is disposed in the vertical direction, the opening surface of the opening 81 is inclined also to the horizontal plane.

Therefore, the first hollow pipe 8 is configured in a manner such that, even if the liquid surface in the sub tank 4 has risen to the position below the opening 81, the liquid surface can rise to the highest position 81H of the opening 81 while the entire opening 81 is not covered with the liquid surface immediately. In the present embodiment, the highest position 81H of the opening 81 is disposed near the upper surface 41 of the sub tank 4. Therefore, a space occupied by the air can be reduced to as small as possible when the sub tank 4 is in the full state.

Although the first hollow pipe 8 is made of a metal conductive member in the present embodiment, the material is not restrictive: any conductive member may be used. Regarding the first hollow pipe 8, only a portion to be conductive as an electrode may be formed by a conductive member, and other portions may be formed by non-conductive members. The first hollow pipe 8 is disposed to perpendicularly cross the upper surface 41 of the sub tank 4 in the present embodiment, but perpendicularity is not necessary.

Electrode Portion

Hereinafter, a solid pipe 10 (an electrode portion) which is a feature of aspects of the present invention is described.

In the present embodiment, the metal solid pipe 10 (the electrode portion) which functions as the electrode is provided at an upper portion of the sub tank 4. An ink amount in the sub tank 4 (a full state) is detectable in accordance with the electrical properties between the first hollow pipe 8 (the first electrode) and the solid pipe 10 (the second electrode).

That is, when the first hollow pipe 8 and the solid pipe 10 electrically communicate with each other as the liquid surface in the sub tank 4 rises, a voltage between the first hollow pipe 8 and the solid pipe 10 becomes a prescribed value or below. In this case, the ink amount in the sub tank 4 can be determined (detected) to be a prescribed amount or greater (the full state).

If the liquid surface in the sub tank 4 has not reached the first hollow pipe 8 or the solid pipe 10, the voltage between the first hollow pipe 8 and the solid pipe 10 becomes a prescribed value or greater. In this case, it can be determined (detected) that the ink amount in the sub tank 4 is less than the prescribed amount (not the full state). A detecting unit for detecting (determining) a full state is a later-described sensor controller 308.

As illustrated in FIG. 2A, in the present embodiment, the solid pipe 10 is provided along the vertical direction in the upper surface 41 of the sub tank 4. That is, the solid pipe 10 is disposed to perpendicularly cross the upper surface 41.

A lower end 10L of the solid pipe 10 is provided to project in the internal space of the sub tank 4 from the upper surface. In particular, the lower end 10L (a lower end position) of the solid pipe 10 is located at or above a lower end position 8L of the end 8B (the lower end) of the first hollow pipe 8 and at or below the highest position 81H of the opening 81.

Since the lower end 10L (the lower end position) of the solid pipe 10 is located at or above the lower end position of the first hollow pipe 8 (i.e., at or above the position at which an ink dripping portion D appears), the liquid surface has already reached a position at or above the position of the lower end 8B of the first hollow pipe 8 when the liquid surface in the sub tank 4 reaches the lower end 10L of the solid pipe 10. Therefore, when the first hollow pipe 8 and the solid pipe 10 communicate with each other electrically by the ink (the liquid surface) (i.e., the full state), no ink dripping portion D exists at the lower end position 8L of the first hollow pipe 8 (i.e., the ink dripping portion D is eliminated). That is, since the first hollow pipe (the opening 81) and the solid pipe 10 are disposed in the present embodiment, an influence of the ink dripping portion D is avoided when full-state detection of the sub tank 4 is conducted, and the ink amount in the sub tank 4 can be detected correctly.

Rise of the liquid surface in the sub tank 4 is stopped when the opening 81 is covered with the liquid surface. Therefore, it is necessary to dispose the lower end 10L (the lower end position) of the solid pipe 10 corresponding to the full state (the full position) of the sub tank 4 at or below the highest position of the opening 81. That is, the liquid surface in the sub tank does not exceed the highest position 81H of the opening 81.

In the present embodiment, the solid pipe 10 is disposed to cross the upper surface 41 perpendicularly, but perpendicularity is not necessary.

Filling Unit

In the present embodiment, the sub tank 4 and the recording head 1 communicate with each other via the supply tube 2, and the ink reservoir 3 (the filling unit) of which volume is variable formed by a flexible member is provided on the channel between the recording head 1 and the sub tank 4.

The ink reservoir 3 is formed by a flexible member whose internal volume can be increased or decreased. The ink reservoir 3 is driven by a driving member 3A to be expanded or contracted. When the ink reservoir 3 is expanded, ink flows into the ink reservoir 3, and when the ink reservoir 3 is contracted, ink flows out of the ink reservoir 3.

Since the side of the recording head 1 downstream of the ink reservoir 3 has channel resistance sufficiently greater than that of the side of the sub tank 4 upstream of the ink reservoir 3, the ink flow from the ink reservoir 3 toward the recording head 1 can be ignored when the ink reservoir 3 is contracted. That is, as illustrated in FIG. 4A described later, the ink flows more easily in the direction of P1 and less easily in the direction of P2.

Similarly, the ink flow from the recording head 1 to the ink reservoir 3 can also be ignored when the ink reservoir 3 is expanded. That is, as illustrated in FIG. 4A described later, the ink flows more easily in the direction of Q1 and less easily in the direction of Q2.

Therefore, the sub tank 4 is pressurized when the ink reservoir 3 is contracted and the sub tank 4 is depressurized when the ink reservoir 3 is expanded. Therefore, with the ink reservoir 3, the sub tank 4 is depressurized to move the ink in the ink tank 5 into the sub tank 4, and the sub tank 4 is pressurized to move the air in the sub tank 4 into the ink tank 5.

A flexible member for alleviating pressure may be provided in the channel between the ink reservoir 3 and the recording head 1. In this case, pressure fluctuation on the side of the recording head 1 due to contraction and expansion of the ink reservoir 3 is further alleviated by the flexible member, and movement of the ink between the ink reservoir 3 and the recording head is further decreased (i.e., can further be ignored).

With the deformation of the ink reservoir 3, air in the sub tank 4 is pushed out to the ink tank 5, and the ink is drawn into the sub tank 4 from the ink tank 5. That is, with the deformation of the ink reservoir 3, the sub tank 4 is filled with the ink from the ink tank 5.

Air Communication Portion

As illustrated in FIG. 2A, the recording apparatus 30 is provided with the air communication portion 6 disposed below the ink tank 5 and having an air communication passage 7 communicating with air. A second hollow pipe 9 is provided at an upper surface of the air communication portion 6.

When the ink tank 5 is attached to the apparatus main body (the air communication portion 6), an upper end of the second hollow pipe 9 penetrates the second joint portion and is located inside of the ink tank 5. The air communication portion 6 and the ink tank 5 communicate with each other by the second hollow pipe 9. In the present embodiment, the second hollow pipe 9 is formed by a metallic material having conductivity.

When the ink reservoir 3 contracts or when the ambient temperature rises, the pressure in the ink tank 5 increases, and the ink in the ink tank 5 is moved to the air communication portion 6 through the second hollow pipe 9. When the ink reservoir 3 expands or when the ambient temperature is lowered, the pressure in the ink tank 5 is reduced, and the ink or air collected in the air communication portion 6 through the second hollow pipe 9 is moved to the ink tank 5. An internal space of greater than a prescribed volume is formed in the air communication portion 6 so that the ink moved from the ink tank 5 may not overflow to the exterior through the air communication passage 7.

3. Control Mechanism of Inkjet Recording Apparatus

Figure 3:
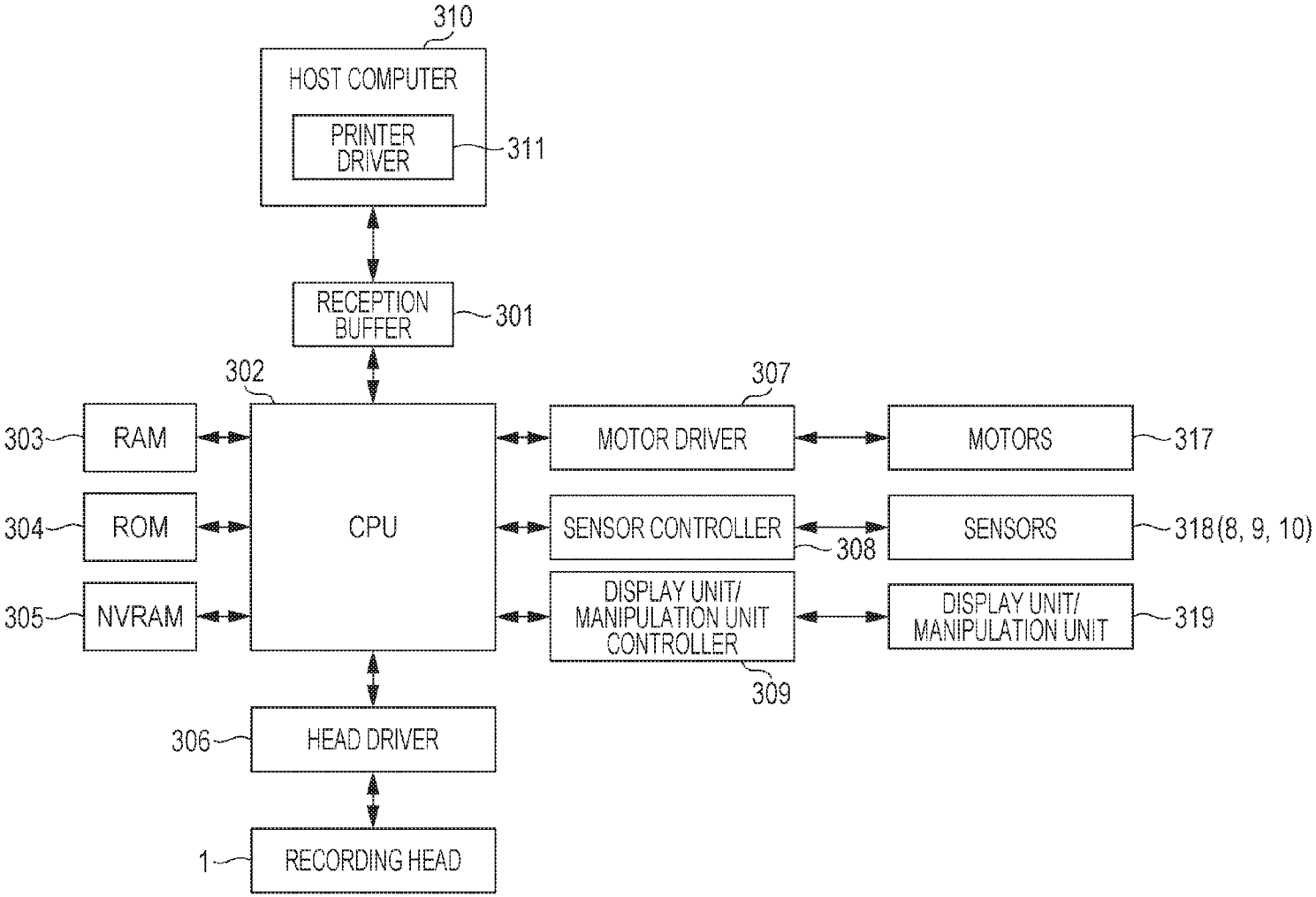
FIG. 3 is a block diagram illustrating a control mechanism of the inkjet recording apparatus according to the first embodiment.

FIG. 3 is a block diagram illustrating a control mechanism of the inkjet recording apparatus of the present embodiment.

As illustrated in FIG. 3, the recording apparatus 30 is provided with a reception buffer 301 for receiving and holding information, such as recording data, transmitted mainly from a host computer 310, and a CPU 302 (a control unit) for processing the information.

The host computer 310 is provided with a printer driver 311 stored as software. The printer driver 311 generates print data from image data, such as document and photograph, in accordance with a print command by a user, and transmits the print data to the reception buffer 301 of the recording apparatus 30. Information, such as the recording data, held by the reception buffer 301, is transmitted to the RAM 303 under the management of the CPU 302 and is stored temporarily.

The recording apparatus 30 has ROM 304 for storing programs, fixed data, and the like necessary for various control, and non-volatile memory NVRAM 305 capable of keeping stored information even after the power is turned off. The recording apparatus 30 is provided with a head driver 306 for driving the recording head 1, and a motor driver 307 for driving other motors. The motor driver 307 can drive various motors 317 including a carriage motor, a conveyance motor, a motor for moving the cap up and down, and a motor for driving the ink reservoir.

The recording apparatus 30 is provided with the sensor controller 308 (a detecting unit) for controlling various sensors 318, and a display unit/manipulation unit controller 309 for controlling a display unit or a manipulation unit 319 of the recording apparatus. In the present embodiment, various sensors 318 are constituted by the first hollow pipe 8, the second hollow pipe 9, the solid pipe 10, and the like.

The host computer 310 is connected with the recording apparatus 30 by, for example, a USB interface. The CPU 302 can execute various processing operations of calculation, control, determination, and setup, together with the RAM 303, the ROM 304, the NVRAM 305, and the like.

(3-1) Sub Tank Filling Control of Inkjet Recording Apparatus

In the present embodiment, even after the ink in the ink tank is consumed and the ink tank is emptied, the recording operation can be continued using the ink in the sub tank 4. After the empty ink tank 5 is replaced with a new one, the sub tank 4 is filled with the ink from the ink tank 5.

Hereinafter, control to fill the sub tank 4 with the ink from the ink tank 5 is described with reference to FIGS. 4A to 4D and 5. For the ease of explanation, suppose that the replaced new ink tank 5 has the same as or greater than the amount of ink containable in the sub tank 4.

Figure 4B:
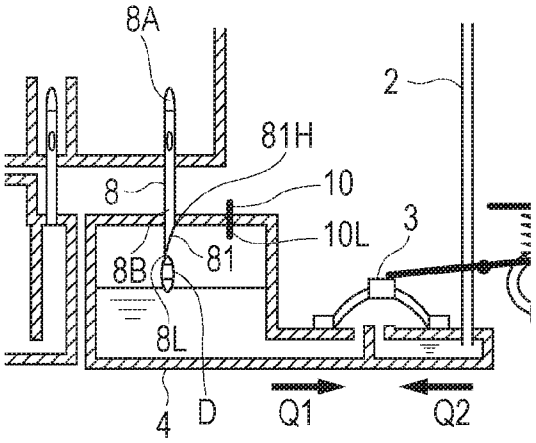
FIGS. 4A to 4D are conceptual diagrams illustrating a sub tank filling operating state in the inkjet recording apparatus according to the first embodiment.
Figure 4A:
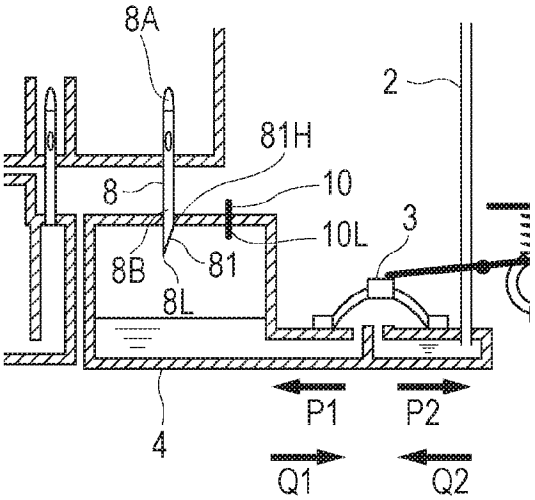

FIGS. 4A to 4D are conceptual diagrams illustrating the operation (the state) to fill the sub tank with the ink from the ink tank. FIG. 4A illustrates a state immediately after the ink tank 5 is replaced. FIG. 4B illustrates a state where the sub tank 4 is partially filled with the ink from the ink tank 5 by the filling unit (the ink reservoir 3). The ink dripping portion D is formed at the lower end of the first hollow pipe 8.

Figure 4D:
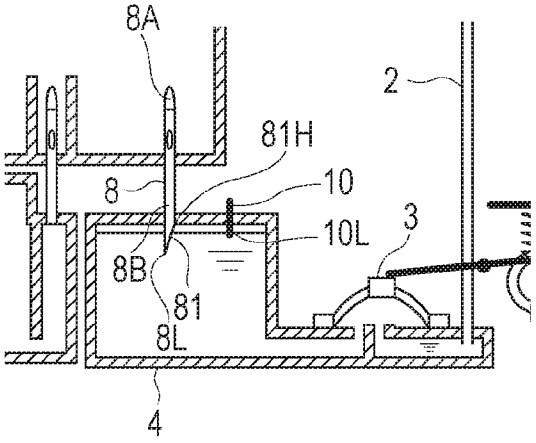
Figure 4C:
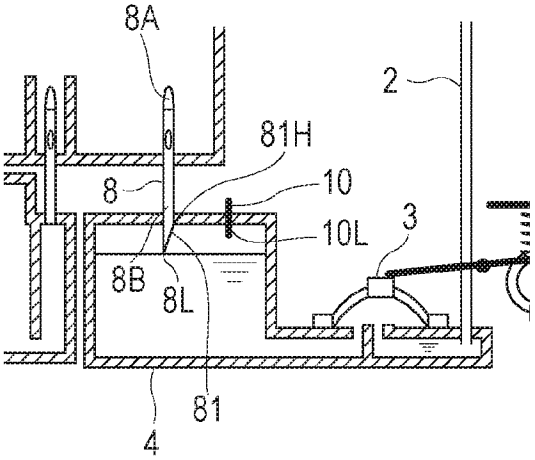

FIG. 4C illustrates a state where the sub tank 4 is continuously filled with the ink from the ink tank 5 by the filling unit (the ink reservoir 3), and the liquid surface has reached the lower end 8L of the first hollow pipe 8. FIG. 4D illustrates a state where the liquid surface in the sub tank 4 has reached the lower end 10L of the solid pipe 10. At this time, the first hollow pipe 8 and the solid pipe 10 electrically communicate with each other through the liquid surface, and the full state of the sub tank 4 is detected by the detecting unit 308.

Figure 5:
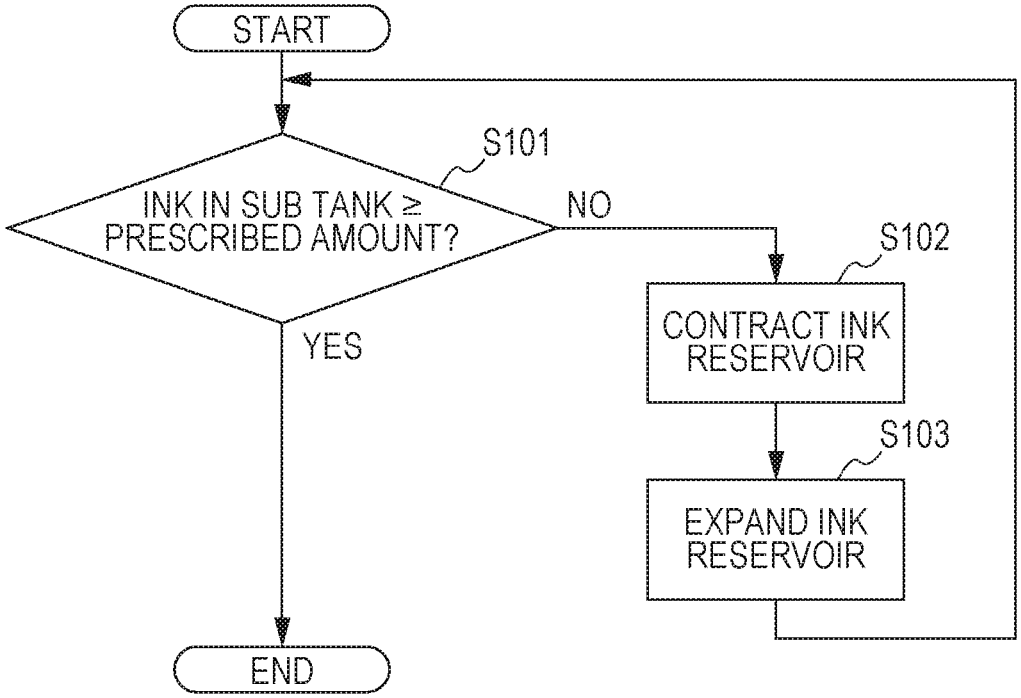
FIG. 5 is a flowchart of filling control of the sub tank in the inkjet recording apparatus according to the first embodiment.

FIG. 5 is a flowchart of the filling control of the sub tank. As illustrated in FIG. 5, when a new ink tank 5 is attached to the apparatus main body by an attachment detecting unit (not illustrated), the filling control of the sub tank is started.

Upon detection of attachment of the ink tank 5, the sensor controller 308 determines whether the ink amount in the sub tank is equal to or greater than a prescribed amount (a full state) in accordance with electrical properties between the first hollow pipe 8 and the solid pipe 10 (S101). If the ink amount in the sub tank is in the full state, the filling control of the sub tank is completed. If the ink amount in the sub tank is not in the full state, the sub tank 4 is filled with the ink from the ink tank 5.

When the sub tank is filled with ink, the ink reservoir 3 is contracted first (S102) so that the air in the sub tank 4 is pushed out to the ink tank 5.

Then the ink reservoir 3 is expanded (S103) so that the ink is drawn into the sub tank 4 from the ink tank 5.

Whenever the ink is drawn into the sub tank 4, whether the ink amount in the sub tank 4 has reached at or greater than a prescribed amount (the full state) is determined. A series of this operation (S101 to S103) is repeated.

(3-2) Empty-State Detection of Ink Tank, and Ink Amount Detection Control of Sub Tank As described above, in the present embodiment, even after the ink in the ink tank is consumed, the recording operation can be continued using the ink in the sub tank 4. If the ink remains in the ink tank 5, the full state of the sub tank 4 is always kept. Therefore, when it is detected that the sub tank 4 is no more in the full state, it can be estimated that the ink tank 5 has become an empty state (empty-state detection).

Empty-state detection of the ink tank 5 is the same as that of the full-state detection of the sub tank described above. If the ink tank 5 is emptied and the ink in the sub tank 4 begins to be consumed, management of the ink amount in the sub tank 4 becomes necessary. If the ink in the sub tank 4 is consumed excessively, there is a possibility that air in the sub tank 4 enters the downstream side (the recording head side).

An exemplary method for detecting the ink amount in the sub tank after the sub tank 4 is not in the full state any more is to count the ink amount ejected from the recording head 1. That is, since the ink amount when the sub tank 4 is in the full state is the prescribed amount, the ink amount in the current sub tank 4 can be estimated by counting the ink amount discharged from the recording head side after the sub tank 4 is not in the full state any more. Therefore, no air enters the downstream side if the ink tank 5 is replaced before the ink amount (the liquid surface) in the sub tank 4 reaches the lower limit.

(3-3) Air Vent Control of Recording Head

Suction discharging of the air bubbles which were generated in recording head 1 using a suction pump 108 can be carried out (air extraction). Even if the suction pump 108 is operated with the channel between the sub tank 4 and the recording head 1 open, air bubbles in the recording head are less easily discharged. For this reason, the channel needs to be closed temporarily before operating the suction pump 108.

In the present embodiment, the ink reservoir 3 may also function as a valve for opening and closing the channel between the recording head 1 and the sub tank 4. The channel between the sub tank 4 and the recording head 1 is closed when the ink reservoir 3 is contracted, and the channel is opened when the ink reservoir 3 is expanded. Therefore, the channel can be opened and closed depending on the state of the ink reservoir 3.

In particular, "air vent" control in the recording head is conducted as follows: after closing the channel by the ink reservoir 3, the cap 106 is brought into close contact with the ejection port surface 102 of the recording head 1 and sucked from the recording head 1 to generate negative pressure in the cap 106. A large ink flow is produced from the sub tank 4 to the recording head 1 by switching the channel from the closed state to the opened state by the ink reservoir 3 with the negative pressure generated in the cap 106. Air bubbles in the recording head 1 are discharged by the cap 106 together with the ink flow.

Second Embodiment

Hereinafter, an inkjet recording apparatus according to a second embodiment is described with reference to FIGS. 6 and 7.

Figure 6:
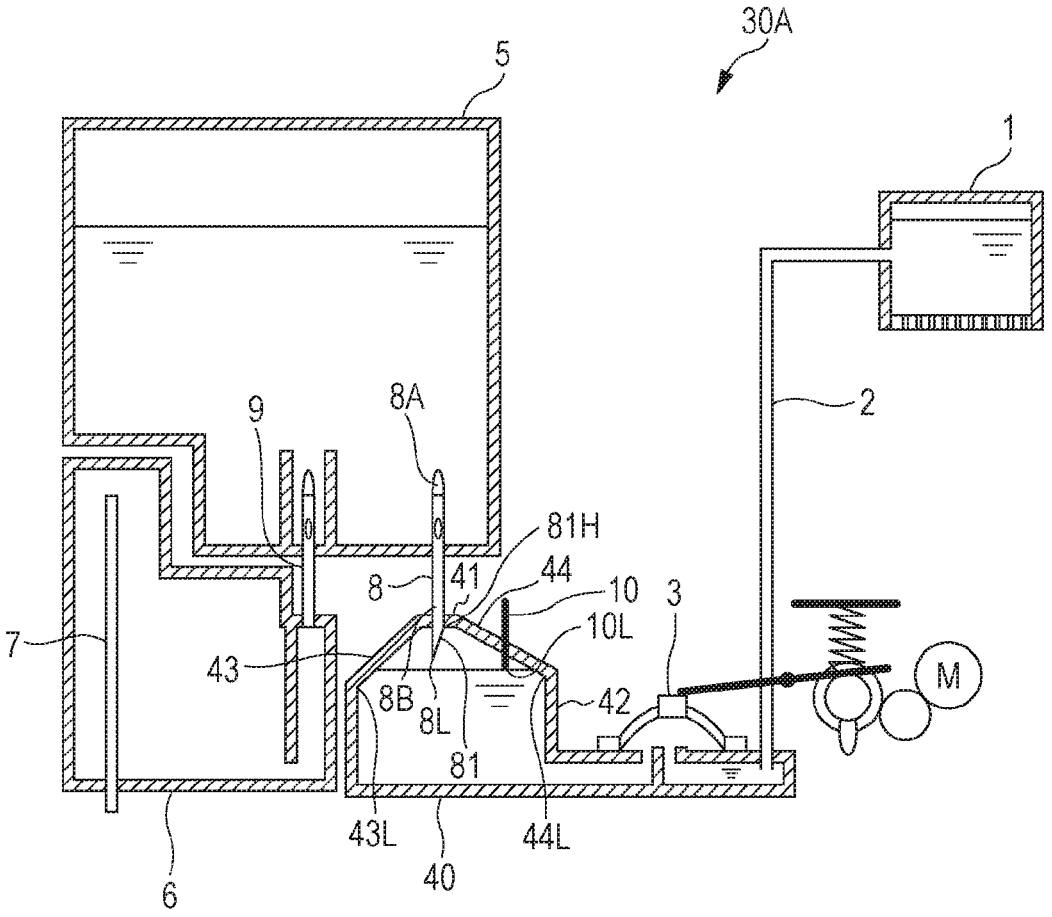
FIG. 6 is conceptual diagram of an ink channel of an inkjet recording apparatus according to a second embodiment.

FIG. 6 is a conceptual diagram of an ink channel of the inkjet recording apparatus 30A according to the second embodiment.

As illustrated in FIG. 6, in the present embodiment, an inclined surface 43 and an inclined surface 44 are provided between an upper surface 41 and a side surface 42 of a sub tank 40, and the upper surface 41 and the side surface 42 are connected by the inclined surfaces 43 and 44. A first hollow pipe 8 is provided on the upper surface 41, and a solid pipe 10 is provided on the inclined surface 44.

Also in the present embodiment, a lower end position 10L of the solid pipe 10 is located at or above a lower end position 8L of the first hollow pipe 8 and at or below a highest position 81H of an opening 81. The lower end 10L (a lower end position) of the solid pipe 10 and the lower end position 8L of an end 8B of the first hollow pipe 8 are disposed at substantially the same height. The lower end position 10L and the lower end position 8L are located at positions higher than lower end positions 43L and 44L of the inclined surfaces 43 and 44.

In the present embodiment, the lower end position 10L of the solid pipe 10 has a greater distance to the upper surface 41 than in the first embodiment. For this reason, when the first hollow pipe 8 and the solid pipe 10 electrically communicate with each other by the rise of a liquid surface (i.e., full-state detection is conducted), a space occupied by air between the liquid surface (positions 10L and 8L) and the upper surface 41 is still large. Since the highest position 81H of the opening 81 is located near the upper surface 41, there is a room to further fill the ink in the sub tank 40.

Figure 7:
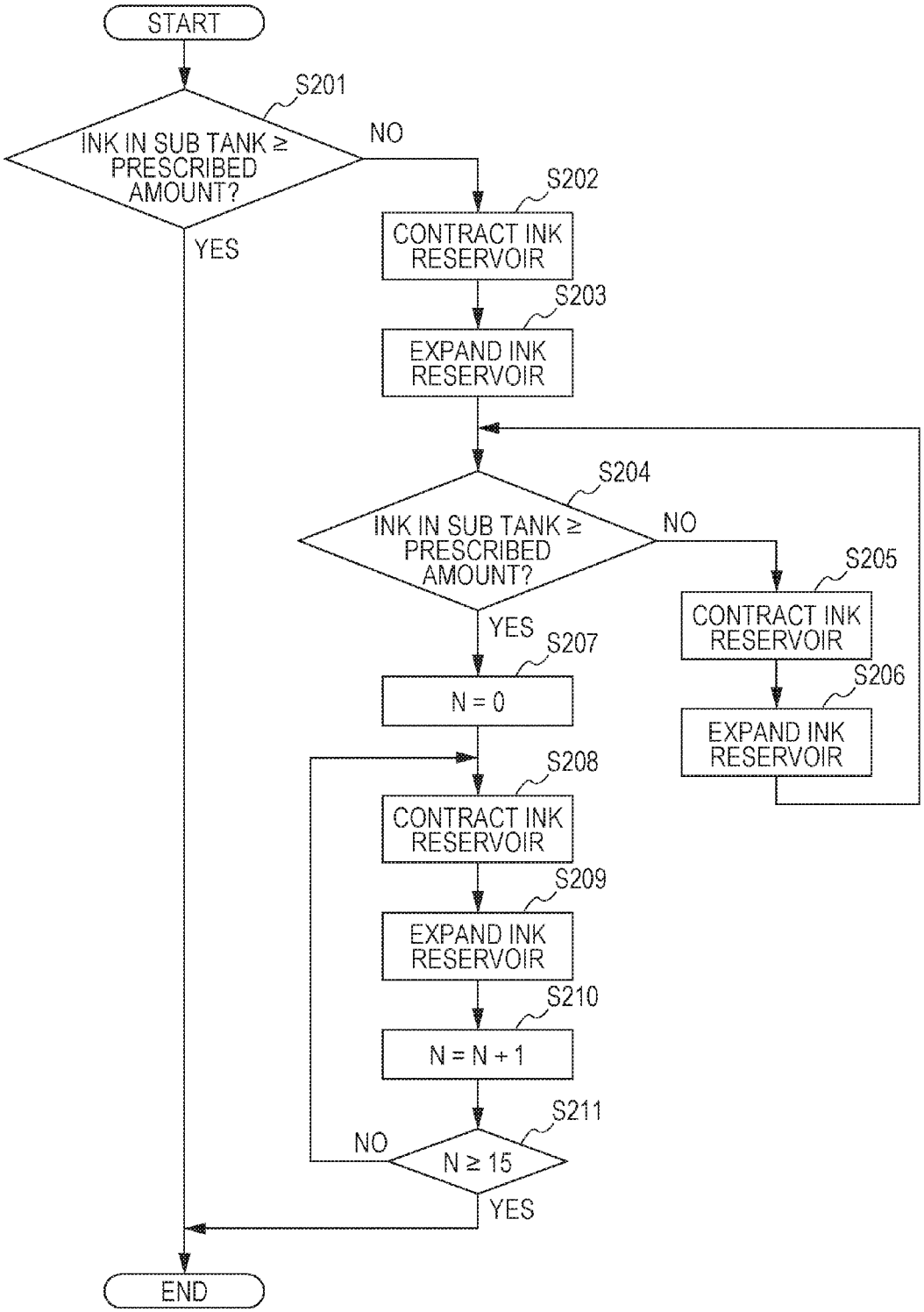
FIG. 7 is a flowchart of filling control of a sub tank in the inkjet recording apparatus according to the second embodiment.

FIG. 7 is a flowchart of filling control of the sub tank of the present embodiment.

As illustrated in FIG. 7, when a new ink tank 5 is attached to an apparatus main body by an attachment detecting unit (not illustrated), filling control of the sub tank is started.

Upon detection of attachment of the ink tank 5, the sensor controller 308 determines whether the ink amount in the sub tank is equal to or greater than a prescribed amount (a full state) in accordance with electrical properties between the first hollow pipe 8 and the solid pipe 10 (S201). If the ink amount in the sub tank is in the full state, the filling control of the sub tank is completed. If the ink amount in the sub tank is not in the full state, the sub tank 40 is filled with the ink from the ink tank 5.

When the sub tank is filled with ink, the ink reservoir 3 is contracted first (S202) so that the air in the sub tank 40 is pushed out to the ink tank 5.

Then the ink reservoir 3 is expanded (S203) so that the ink is drawn into the sub tank 40 from the ink tank 5.

Whenever the ink is drawn into the sub tank 40, whether the ink amount in the sub tank 40 has reached at or greater than a prescribed amount (the full state) is determined (S204).

If it is determined in step S204 that the sub tank 40 is not in the full state, the ink reservoir 3 is contracted (S205) and air is pushed out to the ink tank. The ink reservoir 3 is then expanded (S206) and ink is drawn into the sub tank. A series of this operation (S204 to S206) is repeated.

If it is determined in step S204 that the sub tank 40 is in the full state, a control unit (302) makes a storage unit (not illustrated) store the number N=0 (S207). At this time, the liquid surface of the ink in the sub tank 40 has reached the lower end positions 8L and 10L.

The following operations are performed to continuously fill the sub tank 40 with ink from the position 8L to the position 81H.

In particular, the ink reservoir 3 is contracted (S208), the air existing in the upper space of the sub tank 40 is pushed out to the ink tank and the ink reservoir 3 is expanded (S209), and the ink is drawn into the sub tank from the ink tank. Whenever the ink is drawn into the sub tank 40, the control unit (302) updates the number of times N as the number of times N=N+1 in the storage unit (S210). A series of operation (S208 to S210) is repeated until the number of times N stored in the storage unit is updated to 15.

When the number of times N stored in the storage unit becomes 15 or greater (S211), it is estimated that the liquid surface of the ink in the sub tank 40 has reached the position 81H, and the filling control of the sub tank is completed. In the present embodiment, the number of times N≥15 for repeating is a prescribed value set in advance depending on the volume of the sub tank 40 between the position 8L (10L) and the position 81H, and the number of times N can be changed suitably in accordance with the position 8L (10L) and the position 81H.

Figure 8A:
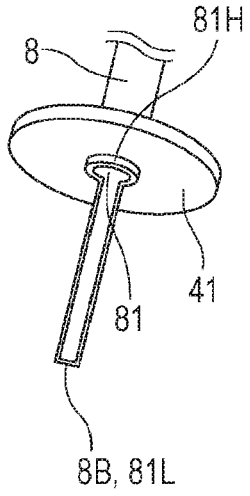
FIGS. 8A to 8C are conceptual diagrams of a main part of an inkjet recording apparatus according to other embodiments.
Figure 8B:
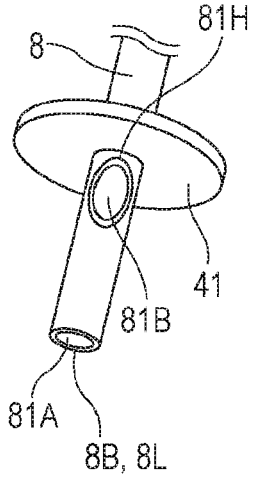

Other Embodiments (1) The opening 81 is formed by obliquely cutting the lower end 8B of the first hollow pipe 8 in the first and the second embodiments (see FIG. 2B), but the shape of the opening 81 is not limited to the same: for example, the shapes illustrated in FIGS. 8A and 8B may be used.

Figure 8C:
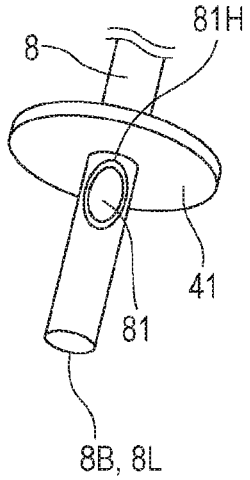
Figure 9:
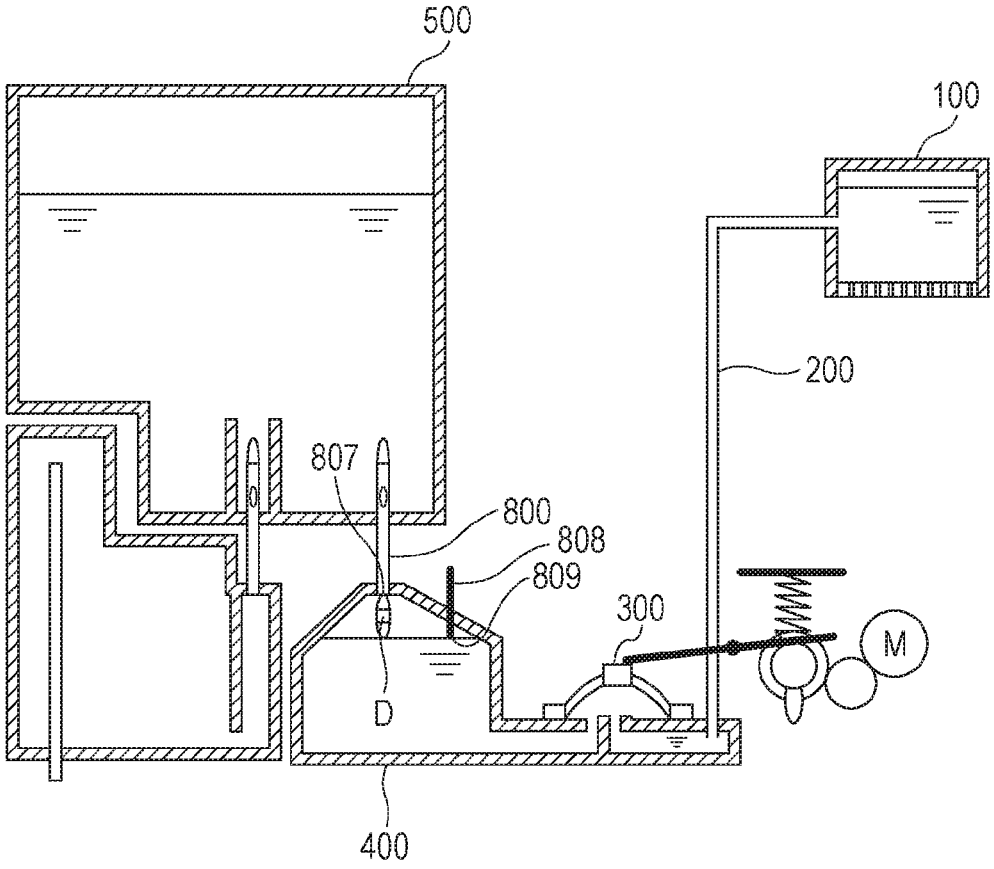
FIG. 9 is a conceptual diagram of an ink channel of a related art inkjet recording apparatus.

FIGS. 8A to 8C are conceptual diagrams of a main part of additional embodiments. Specifically, Modification of an opening 81 formed in a lower end 8B of a first hollow pipe 8 is illustrated in FIGS. 8A to 8C.

(1-1) First Modification

As illustrated in FIG. 8A, the opening 81 may be formed by cutting an end (a lower end) 8B of the first hollow pipe 8 in a rectangular shape.

In this case, it is only necessary that a lower end position 10L of a solid pipe is disposed between a lowest position 81L and a highest position 81H of the opening 81.

When full-state detection is conducted, since a liquid surface is located at or above the lowest position of the opening 81 (a position at which an ink dripping portion D appears), detection is not affected by the ink dripping portion D.

(1-2) Second Modification

As illustrated in FIG. 8B, an opening 81 has a first opening 81A and a second opening 81B. The second opening 81B is disposed at a position higher than the first opening 81A. Specifically, the first opening 81A is formed as a circular opening at an end surface of a lower end 8B (a lower end position 8L) of a first hollow pipe 8. The second opening 81B is as a long hole formed on a side wall of the first hollow pipe 8.

In this case, it is only necessary that a lower end position 10L of a solid pipe 10 is disposed between the first opening 81A located at a lower position and (a highest position 81H of) the second opening 81B located at an upper position.

When full-state detection is conducted, since a liquid surface is located at or above the first opening 81A located at the lower position (a position at which an ink dripping portion D appears), detection is not affected by the ink dripping portion D.

(1-3) Third Modification

As illustrated in FIG. 8C, an opening 81 is formed as a long hole on a side wall of a first hollow pipe 8. No opening is provided at an end surface (a lower end position 8L) of a lower end 8B of the first hollow pipe 8.

In this case, it is only necessary that a lower end position 10L of a solid pipe 10 is disposed between a lowest position 81L of the first hollow pipe 8 and a highest position 81H of the opening 81.

When full-state detection is conducted, since a liquid surface is located at or above the lowest position 8L of the first hollow pipe 8 (a position at which an ink dripping portion D appears), detection is not affected by the ink dripping portion D.

(2) The first hollow pipe 8 or the solid pipe 10 does not necessarily have to be formed by a metal material, and needs to have conductivity only at a part which functions as an electrode.

(3) The first hollow pipe 8 does not necessarily have to be a pipe (a needle) in shape, and may be those shapes illustrated in FIGS. 8A to 8C. It is only necessary that the first hollow pipe 8 have the opening 81 at a position higher than the lower end 10L of the solid pipe 10.

(4) The first hollow pipe 8 is disposed in the vertical direction in the first embodiment, but the first hollow pipe 8 may be disposed in directions other than the vertical direction.

(5) An uppermost portion of the opening 81 of the first hollow pipe 8 on the side of the sub tank in the vertical direction is located near an uppermost portion (the upper surface 41) in the sub tank in the vertical direction in the first and the second embodiments, but it is not necessary that the location is near the uppermost portion in the vertical direction.

(6) The ink reservoir 3 is disposed on the channel between the sub tank 4 and the recording head 1, but may be disposed on the side of the ink tank 5. The air communication passage 7 needs to be closed when the ink is pushed out of the ink tank 5 to the sub tank, and when the air is sucked from the sub tank.

(7) Aspects of the present invention are applicable not only to a serial inkjet recording apparatus but to a full line inkjet recording apparatus.

(8) Aspects of the present invention are applicable not only to a thermal inkjet recording apparatus but a piezoelectric inkjet recording apparatus.

According to aspects of the present invention, an influence of wrong detection by ink dropping (a liquid column) can be reduced, and an ink amount in a second ink tank can be detected more correctly.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-076282, filed Apr. 2, 2015, which is hereby incorporated by reference herein in its entirety.

What is claimed is:

1. An inkjet recording apparatus, comprising:

a first ink tank configured to contain ink;

a second ink tank configured to contain ink supplied from the first ink tank;

a hollow pipe, having conductivity, configured to connect the first ink tank and the second ink tank, and having an opening provided at one end connected to the second ink tank, said opening being open into the second ink tank, wherein the hollow pipe is provided on an upper surface of the second ink tank in a gravity direction when ink is supplied from the first ink tank to the second ink tank via the hollow pipe;

an electrode provided on the upper surface of the second ink tank; and a detecting unit configured to detect that an ink amount in the second ink tank is greater than a prescribed amount by applying an electric current between the hollow pipe and the electrode, wherein a lower end position of the hollow pipe is below a lower end position of the electrode in the gravity direction, and a highest position of the opening is above the lower end position of the electrode in the gravity direction.

2. The inkjet recording apparatus according to claim 1, wherein the first ink tank is detachable from the second ink tank, and the hollow pipe is provided in the second ink tank.

3. The inkjet recording apparatus according to claim 1, wherein an upper portion of the opening is disposed near an upper surface of the second ink tank.

4. The inkjet recording apparatus according to claim 1, wherein the hollow pipe is formed by a conductive member.

5. The inkjet recording apparatus according to claim 1, wherein the opening is a long hole.

6. The inkjet recording apparatus according to claim 1, wherein an opening surface on which the opening is formed is inclined with respect to an axis direction of the hollow pipe.

7. The inkjet recording apparatus according to claim 1, wherein the opening is provided on a side wall of the hollow pipe.

8. The inkjet recording apparatus according to claim 1, wherein the opening has a first opening and a second opening located higher than the first opening in the gravity direction, and the highest position of the second opening is above the lower end position of the electrode portion in the gravity direction.

9. The inkjet recording apparatus according to claim 1, further comprising a filling unit configured to move air in the second ink tank to the first ink tank and move ink in the first ink tank to the second ink tank to fill the second ink tank with ink, wherein the filling unit moves the ink in the first ink tank to the second ink tank by depressurizing the second ink tank, and moves the air in the second ink tank to the first ink tank by pressurizing the second ink tank.

10. The inkjet recording apparatus according to claim 9, wherein the filling unit includes an ink reservoir with a variable volume.

11. The inkjet recording apparatus according to claim 9, wherein the ink in the first ink tank is moved to the second ink tank and the air in the second ink tank is moved to the first ink tank through the hollow pipe.

12. The inkjet recording apparatus according to claim 1, wherein the detecting unit detects that the ink amount in the second ink tank is greater than the prescribed amount in a case where a voltage value obtained when the electric current is applied between the hollow pipe and the electrode portion is less than a prescribed value.

* * * * *